US005899420A

United States Patent [19]

Gerardi

[11] Patent Number: 5,899,420

[45] Date of Patent: May 4, 1999

[54] MOUNTABLE STORAGE BIN

[76] Inventor: Karen L. Gerardi, 26 Elmire Ave., Worcester, Mass. 01604

[21] Appl. No.: 08/864,838

[22] Filed: May 29, 1997

[51] Int. Cl.[6] ..... A47G 23/02; B65D 25/24; B65D 25/22

[52] U.S. Cl. ..... 248/146; 220/482; 220/475

[58] Field of Search ..... 248/339, 688, 248/690, 692, 146, 220.31, 218.4, 311.2, 519, 518, 127, 126, 176.1, 188; 220/475, 476, 488, 482, 606, 605, 608, 479, 481, 751; 206/372, 373, 315.11, 509, 511; 312/902; 43/54.1

[56] References Cited

U.S. PATENT DOCUMENTS

| | | | |
|---|---|---|---|
| 949,231 | 2/1910 | Hanson | 248/146 |
| 2,138,977 | 7/1938 | Mathews | 248/146 |
| 2,770,513 | 11/1956 | Brown | 220/482 |
| 3,002,650 | 10/1961 | Lovell | 206/509 |
| 3,050,356 | 8/1962 | Messmer | 206/315.11 |
| 3,325,038 | 6/1967 | Ferney | 220/482 |
| 3,369,658 | 2/1968 | Hasselmann | 206/65 |
| 3,477,679 | 11/1969 | Lovitz | 248/311.2 |
| 3,746,210 | 7/1973 | Evans | 220/70 |
| 3,777,885 | 12/1973 | Barteck | 206/72 |
| 3,920,295 | 11/1975 | Speckin | 312/108 |
| 3,944,108 | 3/1976 | Enik | 220/18 |
| 4,122,944 | 10/1978 | DeNapoli | 206/349 |
| 4,460,085 | 7/1984 | Tantzen | 206/349 |
| 4,550,828 | 11/1985 | Baldwin et al. | 206/349 |
| 4,624,383 | 11/1986 | Moore | 220/23.4 |
| 4,653,713 | 3/1987 | Hamilton | 248/238 |
| 4,671,405 | 6/1987 | Hagan | 206/139 |
| 4,703,852 | 11/1987 | Verdier | 206/349 |
| 4,714,158 | 12/1987 | Oltman et al. | 206/349 |
| 5,505,302 | 4/1996 | Ferley | 206/373 |
| 5,507,389 | 4/1996 | Syrek | 206/508 |
| 5,661,941 | 9/1997 | Vataker | 52/604 |
| 5,676,251 | 10/1997 | Credle, Jr. | 206/501 |

FOREIGN PATENT DOCUMENTS

| | | | |
|---|---|---|---|
| 541753 | 6/1957 | Canada | 220/482 |

*Primary Examiner*—Leslie A. Braun
*Assistant Examiner*—Michael D. Nornberg
*Attorney, Agent, or Firm*—David L. Volk

[57] ABSTRACT

A rectangular container has a back surface which has an upper edge and a lower edge. The container also has a lid which is hingably connected to the upper edge of the back surface in order to allow access to the container via rotation of the lid about the upper edge. There is also a plurality of inverted, substantially U-shaped members located on the back surface of the container. These members each have a first prong and a second prong. The first prong of each member is fixably attached to the back surface of the container, and the second prong is adapted to slidably engage a fence. There is also a mounting device located on the bottom of the container. This device can be adapted to receive a cylindrical pole, a square post, or a T-shaped fence post, among other shapes. Any of these support members can support the container.

2 Claims, 3 Drawing Sheets

MOUNTABLE STORAGE BIN

BACKGROUND OF THE INVENTION

1. Field of the Invention

This invention relates to containers, more particularly to stationary storage devices.

2. Description of the Related Art

There are a number of tool boxes and storage devices on the market. Some are molded to fit certain tools specifically, while others have interior trays that extend upon opening. There are even some that hold implements upright for ease of access. None of the storage boxes extant can easily be mounted to keep the storage box off the ground—away from moisture that can rust the tools, out of the grass that can hide them and cause safety hazards, and away from animals and children which can crawl inside the container. These features are especially important for gardeners.

What is needed is a utility implement container that can be easily mounted to a fence or on a post so that tools can be kept where they are used the most. This will reduce the annoyance and frustration associated with carrying tools from their normal storage place to the place of use. It is also important that the utility implement container keep the tools dry to preserve their longevity.

SUMMARY OF THE INVENTION

The mountable storage bin of the present invention includes a rectangular container that has a back surface which has an upper edge and a lower edge. The container also has a lid which is hingably connected to the upper edge of the back surface in order to allow access to the container via rotation of the lid about the upper edge. There is a plurality of inverted, substantially U-shaped members located on the back surface of the container. These members each have a first prong and a second prong. The first prong of each member is fixably attached to the back surface of the container, and the second prong is adapted to slidably engage a fence. There is also a mounting device located on the bottom of the container. This device can be adapted to receive a cylindrical pole, a square post, or a T-shaped fence post, among other shapes. Any of these support members can support the container.

Because the U-shaped members on the back of the container engage a fence, the present invention can easily be hung near a garden on the edge of a homeowner's property. If a fence isn't available, the container can be mounted on a post anywhere in the yard using the mounting device located on the bottom of the container. Because the container is up off the ground, tools will stay drier, thus lasting longer. Also, safety will be promoted because tools won't be left laying in the yard and animals and small children will not be able to crawl inside. Further, tools will conveniently all be where they are needed, when they are needed. Still further features and advantages will become apparent from the ensuing description and drawings.

DETAILED DESCRIPTION

Figure 1:
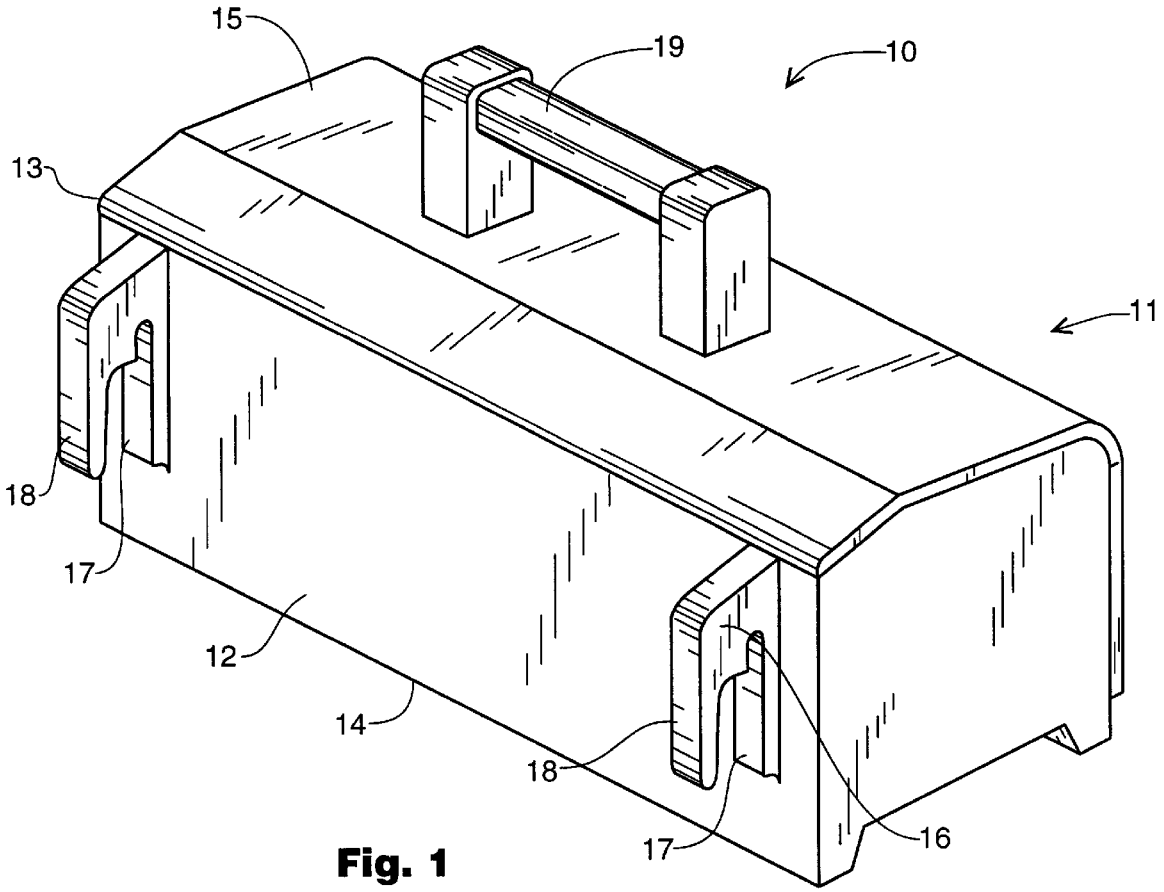
FIG. 1 is a rear perspective view of the mountable storage bin.
Figure 2:
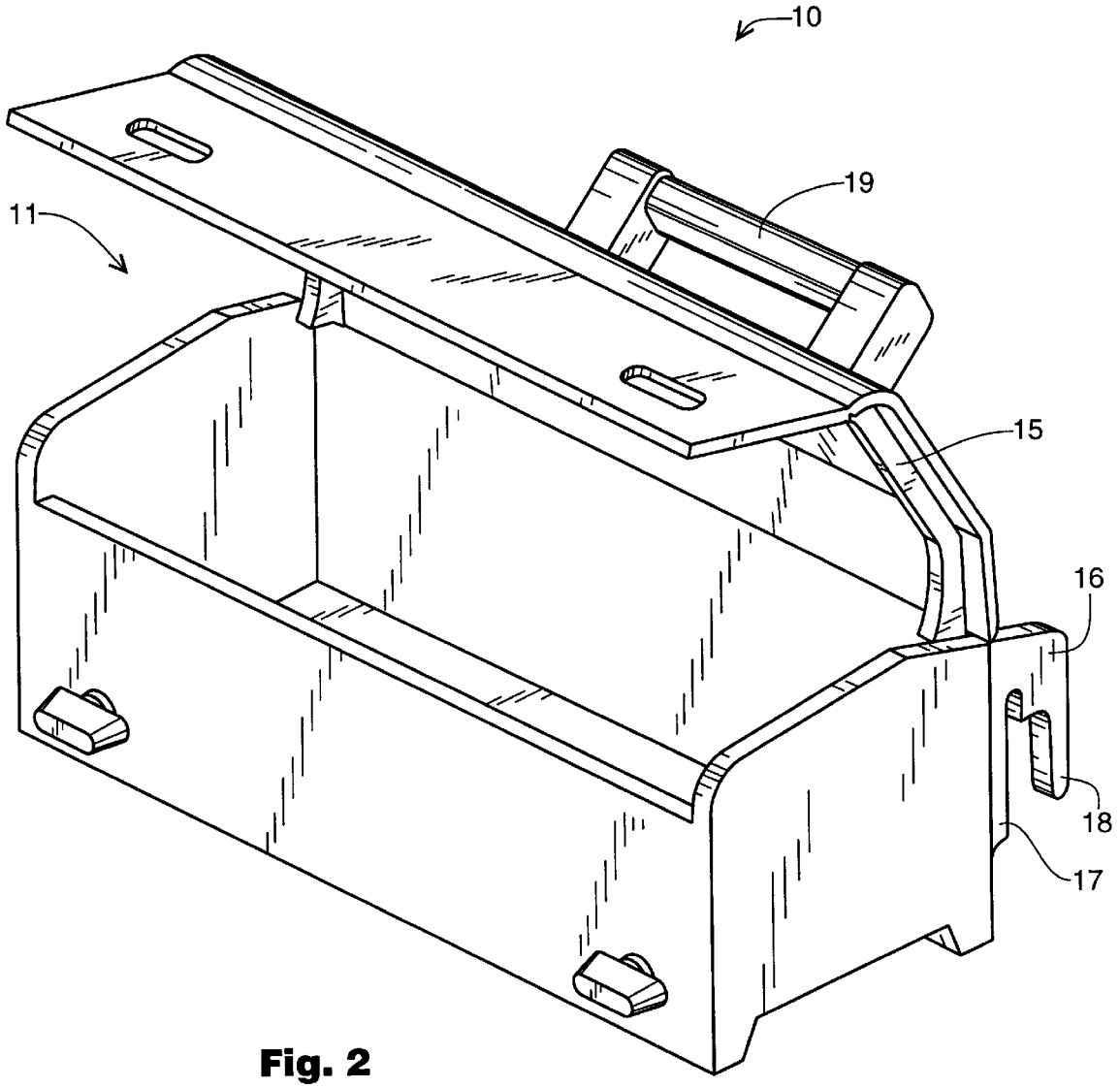
FIG. 2 is a top perspective view of the mountable storage bin of the present invention.

FIG. 1 is a rear perspective view of the mountable storage bin 10 of the present invention. FIG. 2 is a top perspective view of the same. Referring to FIG. 1 and FIG. 2, a rectangular container 11 has a back surface 12 which has an upper edge 13 and a lower edge 14. The container 11 also has a lid 15 which is hingably connected to the upper edge 13 of the back surface 12 in order to allow access to the container 11 via rotation of the lid 15 about the upper edge 13. There is a plurality of inverted, substantially U-shaped members 16 located on the back surface 12 of the container 11. These members 16 each have a first prong 11 and a second prong 18. The first prong 17 of each member 16 is fixably attached to the back surface 12 of the container 11, and the second prong 18 is adapted to slidably engage a fence. A handle 19 is provided for ease of opening the lid 15.

Figure 3:
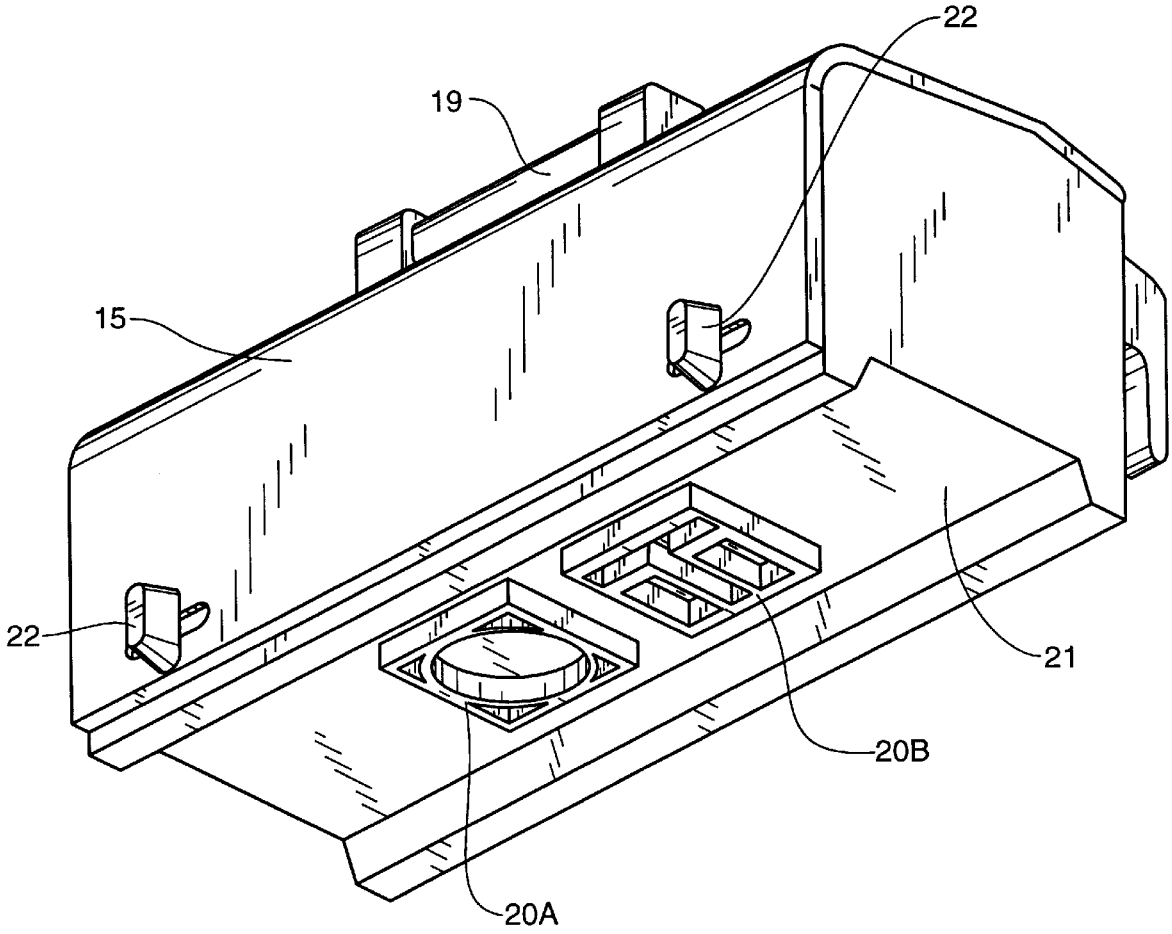
FIG. 3 is a bottom perspective view of the mountable storage bin of the present invention.

FIG. 3 is a bottom perspective view of the mountable storage bin 11 of the present invention. Connecting mechanisms 20A and 20B are attached to the bottom 21 of the container 11. One embodiment of the connecting mechanism 20A is designed to receive a round cylindrical support pole while another embodiment of the mechanism 20B is adapted to receive a T-shaped fencepost. Further, a simple locking mechanism 22 is provided to keep the lid 15 shut tightly.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A storage bin comprising:

a. a rectangular container having a back, a bottom, and a lid; the back having an upper edge and a lower edge, the lid being hingably connected to the upper edge of the back in order to allow access to the container by rotating the lid about the upper edge;

b. a plurality of inverted, substantially U-shaped members located on the back of the structure, the members having a first prong and a second prong, the first prong of each member fixably attached to the back of the container, the second prong adapted to slidably engage a fence;

c. a connecting mechanism attached to the bottom of the containers;

d. the connecting mechanism comprising four strait walls forming a square insert adapted to conformingly fit within an open end of a square elongated support member; and e. the connecting mechanism further comprising structure forming a circular recess between the straight walls and adapted to conformingly receive an end of a round elongated support member.

2. A storage bin comprising:

a. a container having a bottom;

b. a connecting mechanism attached to the bottom of the container;

c. the connecting mechanism comprising four straight walls forming a square insert adapted to conformingly fit within an open end of a square elongated support member;

d. the connecting mechanism further comprising structure forming a T-shaped recess between the straight walls, the recess adapted to conformingly receive an end of a T-shaped elongated support member; and e. a second connecting mechanism comprising four straight second walls forming a second square insert, and structure forming a circular second recess between the second walls.

* * * * *